United States Patent [19]

Gurries

[11] 4,444,434

[45] Apr. 24, 1984

[54] CONTINUOUS MINER

[75] Inventor: Raymond A. Gurries, Reno, Nev.

[73] Assignee: Resonant Technology Company, Sparks, Nev.

[21] Appl. No.: 313,100

[22] Filed: Oct. 20, 1981

[51] Int. Cl.[3] ..... E21C 25/00

[52] U.S. Cl. ..... 299/14; 299/37; 299/78

[58] Field of Search ..... 37/DIG. 18; 299/14, 299/18, 34, 37, 69, 78

[56] References Cited

U.S. PATENT DOCUMENTS

| | | | |
|---|---|---|---|
| 3,563,316 | 2/1971 | Shatto | 299/14 |
| 3,770,322 | 11/1973 | Cobb et al. | 299/14 |
| 4,025,116 | 5/1977 | Roepke et al. | 299/34 |
| 4,251,111 | 2/1981 | Gurries | 299/37 |
| 4,258,956 | 3/1981 | Gurries | 299/14 |
| 4,353,175 | 10/1982 | Gurries | 37/DIG. 18 |

FOREIGN PATENT DOCUMENTS

| | | | |
|---|---|---|---|
| 1484663 | 7/1963 | Fed. Rep. of Germany | 37/DIG. 18 |
| 55-4469 | 1/1980 | Japan | 37/DIG. 18 |

*Primary Examiner*—Stephen J. Novosad
*Assistant Examiner*—William P. Neuder
*Attorney, Agent, or Firm*—Townsend & Townsend

[57] ABSTRACT

A continuous miner includes a pair of resonant beams for driving a cutting blade rigidly secured to their lower anti-nodes. By mounting the beams so that they can pivot about both upper and lower nodes, the miner may be operated to make either vertical or horizontal cuts. When making vertical cuts, the beams are pivoted upward about their upper nodes to drive the blade in an upward arc in front of the miner, the blade being rearwardly off-set from the center line of the beams to reduce blade drag. To make horizontal cuts, the beams are maintained substantially vertically as the miner is driven forward. The precise angle of the blade relative to the ground may be adjusted to reduce blade drag by tilting the beams an appropriate amount about their lower nodes.

12 Claims, 9 Drawing Figures

CONTINUOUS MINER

BACKGROUND OF THE INVENTION

The present invention relates generally to equipment for continuously removing ore from a deposit in the ground. More particularly, the invention concerns a method and apparatus for mining from both surface and underground deposits.

In both surface and underground mining, the ore deposits must be excavated prior to removing the ore from the mine for processing. For surface mining, a variety of machines including bulldozers, power shovels, and the like, are used to remove a seam of ore from the top downward over a large area.

Underground mining presents different requirements. Typically, a vertical face will be incrementally advanced through the seam by cutting away vertical layers in a horizontal shaft. Since the work will be accomplished in an area having limited height and accessibility, the use of bulldozers, power shovels and the like is contraindicated. Conventional continuous miners and load-haul-dump (LHD) machines, both of which operate by digging the ore from the ground, find use underground.

SUMMARY OF THE INVENTION

The present invention is a continuous miner which is able to operate both in surface mines to excavate horizontal layers of earth and ore for processing, as well as in underground mines to unearth arcuate layers in front of the miner.

The continuous miner includes a cutting blade which is mounted at the lower end of a resonant beam. The resonant beam is supported on a mobile frame in such way that the beam may be manipulated relative to the frame. In a first operational mode (referred to hereinafter as the "horizontal mode"), the beam may be tilted about an axis drawn approximately through its lower node. In this way, the angle or pitch of the blade may be adjusted for making horizontal cuts. Typically, the blade will be adjusted so that it cuts downward on the forward (cutting) stroke and moves upward on the reverse stroke to prevent return-stroke drag resulting in power loss and frictional heating of the blade, as will be described in more detail hereinafter.

In a second operational mode (referred to hereinafter as the "vertical mode"), the beam may be manipulated to rotate about a second axis, typically located at the upper node. In this way, while the mobile frame remains stationary, the cutting blade may be rotated upward to cut in an upward arc in front of the frame resulting in the removal of an annular layer. While it is expected that the miner will usually operate in the horizontal mode above ground, and in the vertical mode below ground, the miner is capable of operation in either mode in either location.

When operating either in the horizontal mode or the vertical mode, the resonant beam is resonantly excited to reciprocate the cutting blade to assist the blade in penetrating the ore deposit. Such resonant operation results in highly efficient energy transfer to the blade, saving both fuel and wear on the machinery.

In the preferred embodiment, a pair of resonant beams are each supported at their upper nodes from one end of a support frame which is pivotally secured at its other end to the mobile frame. The support frames, which lie on opposite sides of the mobile frame, are each attached to an upper hydraulic cylinder which operates to tilt the support frame about an axis determined by its point of attachment to the mobile frame. The lower node of each beam is restrained in a bracket which depends from the support frame. The bracket, in turn, is connected to a lower hydraulic cylinder which can extend the lower node about an axis defined by the upper node attachment in order to perform the arcuate cuts described hereinbefore. The cutting blade extends between the lower ends of the two resonant beams which are interconnected to move in unison under the influence of both pairs of hydraulic cylinders.

A scoop is provided at the forward end of the mobile frame for collecting the ore that has been unearthed by the blade. The scoop directs the ore rearward to a collection conveyor running axially along the frame and discharging the ore at the rear of the frame. A crusher may be provided at the discharge to reduce large pieces of ore to an acceptable size.

A particular problem with the conventional underground mining techniques, such as rotary milling, is that the product is accompanied by a high evolution of fines (dust) which not only lead to a loss of product, but also present a substantial hazard from dust and methane explosion, as well as health hazards associated with breathing particulates, such as black lung disease. The impact cutting of the present invention inherently produces less dust than the prior art methods.

The resonant system of the present invention provides pieces of ore which are appropriately-sized for further processing. The ore is neither reduced to fines (as described above) nor left in pieces which are so large that they are unmanageable. Moreover, the resonant system of the present invention requires less energy, lower maintenance, and is inherently more reliable operation than the prior art.

In operation, it is desirable that the cutting blade cut into the ore on the forward (cutting) stroke and return through the previously cut material on the rearward or return stroke. If caused to move through unbroken ore on the return stroke, the blade will have difficulty penetrating the earth and excessive friction will result.

In the horizontal mode the resonant beam is tilted forward so that the lower anti-node (on which the blade is mounted) moves downward on the forward stroke and upward on the rear stroke. That is, the resonant beam is inclined so that the forward most point on the cutting blade, typically the cutting edge, remains behind a perpendicular line drawn from the plane of the ground through the lower node (which is the center of rotation for the blade). Such orientation assures that the blade moves through previously broken material on the return stroke.

In the vertical mode of operation, however, the resonant beam will be rotated and the inclination of the beam cannot be relied on to properly orient the cutting blade. Instead, it is found that during its forward stroke, the blade must remain behind a perpendicular line drawn from a tangent drawn to the cutting arc and through the lower node of the beam. This line coincides with the center line of the beam at its neutral (non-driven) position. Thus, proper operation can be achiegved by off-setting the cutting blade rearward from the center line of the beam. As will be described in more detail hereinafter, however, even with this offset cutting blade, the beam must be oriented properly when cutting in the horizontal mode.

The novel features which are characteristic of the invention, as to organization and method of operation, together with further objects and advantages thereof will be better understood from the following description considered in connection with the accompanying drawings in which a preferred embodiment of the invention is illustrated by way of example. It is expressly understood, however, that the drawings are for the purpose of illustration and description only and are not intended as a definition of the limits of the invention.

DESCRIPTION OF THE PREFERRED EMBODIMENT

Figure 1:
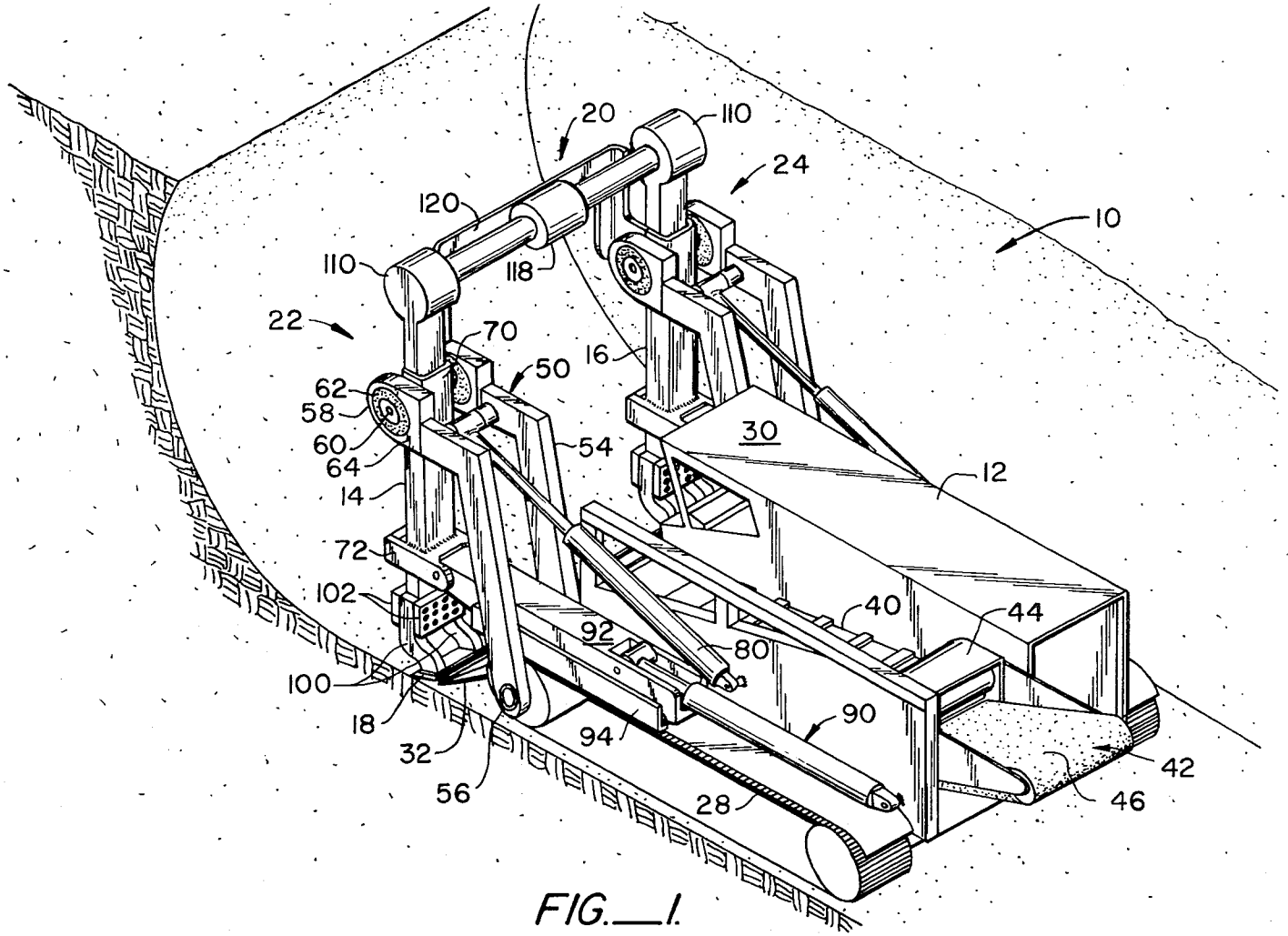
FIG. 1 is an isometric view of the continuous miner of the present invention.
Figure 2:
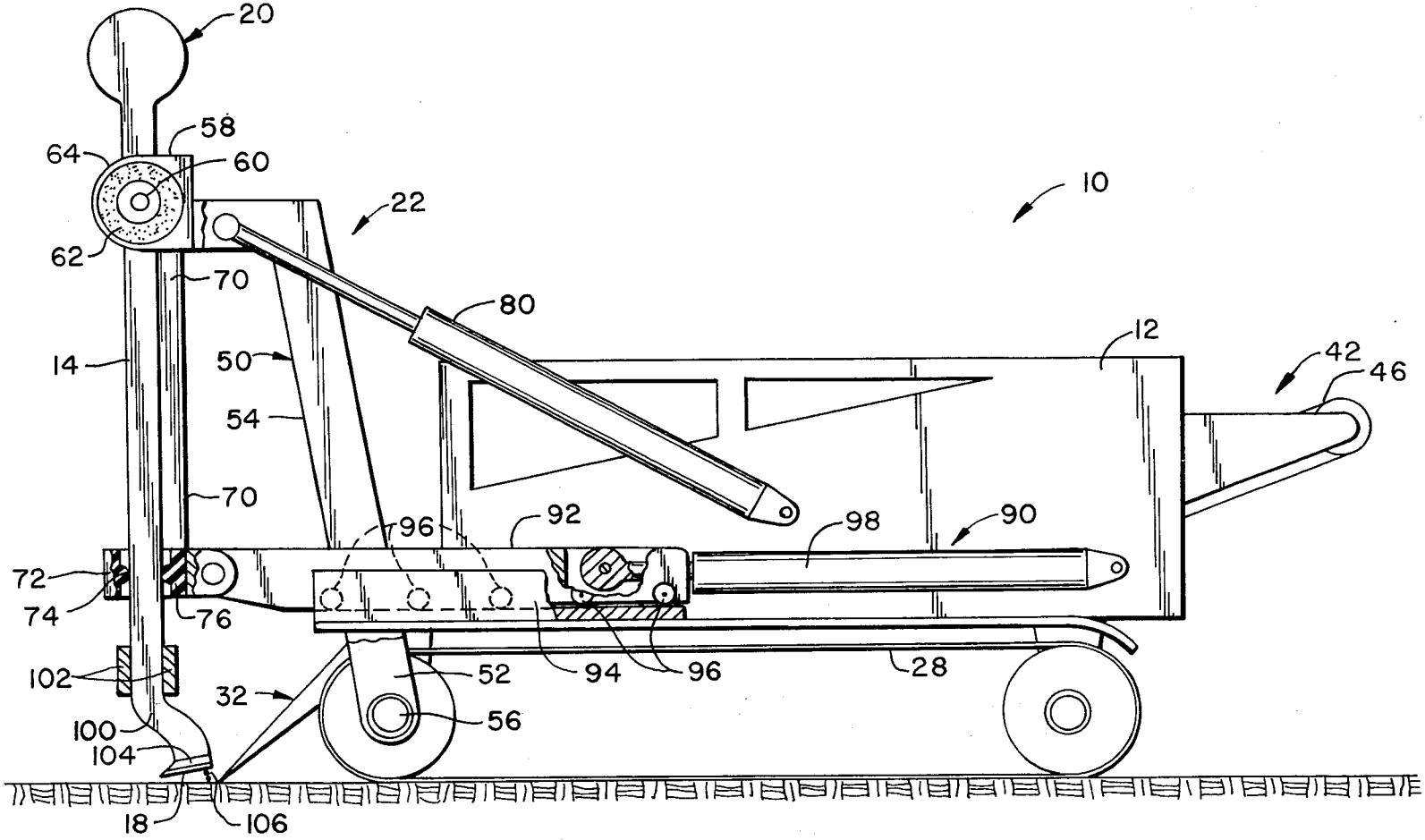
FIG. 2 is a side elevational view of the continuous miner with portion broken away.
Figure 3:
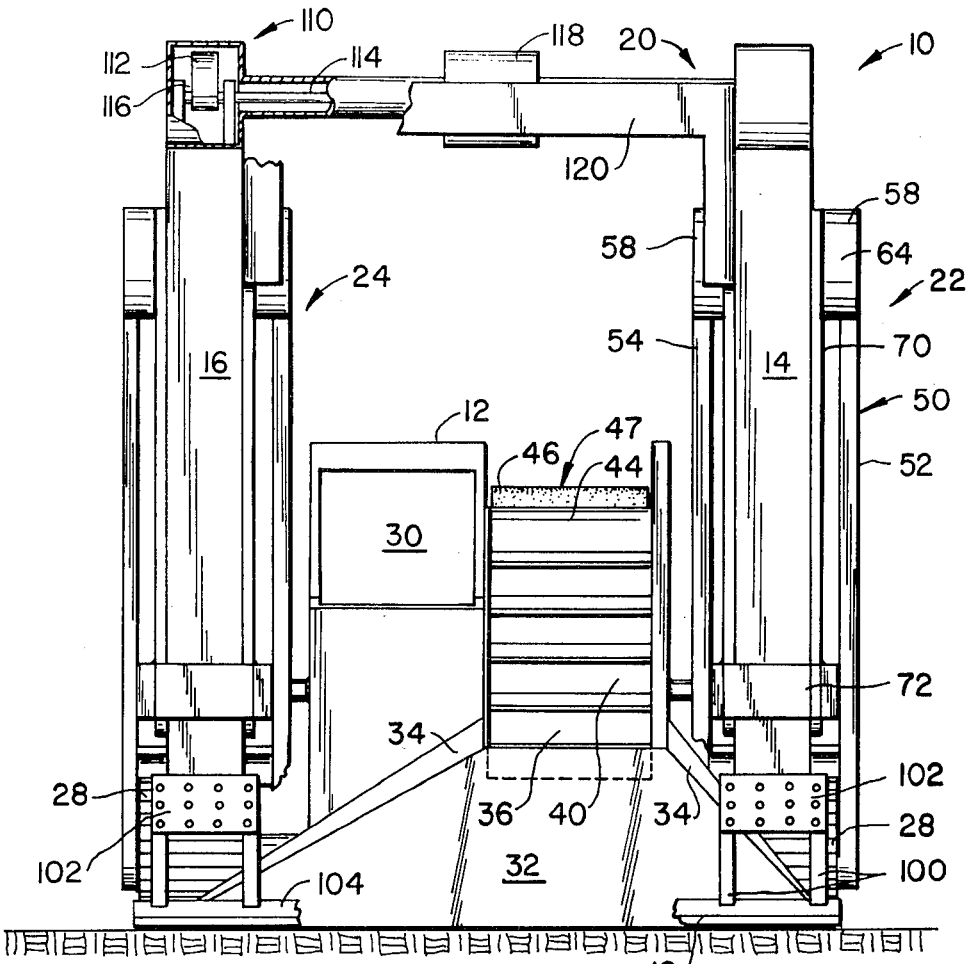
FIG. 3 is a front elevational view of the continuous miner with portions broken away.

Referring to FIGS. 1, 2 and 3, a continuous miner 10 includes a tractor 12, a pair of matched resonant beams 14 and 16, a cutting blade 18 secured to the lower end of each resonant beam and extending therebetween, an oscillatory driver 20 for resonantly exciting the beams to reciprocate the cutting blade, and a pair of substantially identical support assemblies 22 and 24 for supporting and manipulating the beams to excavate ore from the ground with the cutting blade. The support assemblies 22 and 24 are specially adapted so that the miner can be operated in two different modes.

In the first mode (referred to hereinafter as the "horizontal mode"), the beams 14 and 16 are held at a forward inclination so that the blade 18 travels along the ground as the tractor 12 is driven forward (to the left as viewed in FIGS. 1 and 2). In this way, the miner 10 can excavate a horizontal layer of ore from the ground. This mode of operation is particularly useful in surface mining applications where horizontal layers of ore are sequentially removed.

In a second mode of operation (referred to hereinafter as the "vertical mode"), the miner 10 can remove ore from a vertical face, such as those encountered in underground mining applications. To achieve this, the support assemblies 22 and 24 are manipulated to advance the blade 18 in an upward arc in front of the tractor 12. Thus, by incrementally advancing the tractor, material may be removed in a series of annular layers having a thickness determined by the distance of the incremental advance. Both of these modes of operation will be described more fully after the apparatus itself has been described.

The tractor 12 is supported and driven by a pair of tracks 28. The tracks 28 are powered, typically, by a diesel engine (not shown) which also powers one or more hydraulic pumps (not shown) which supply energy to the various hydraulic actuators described hereinafter. An operator sits in a cab 30 which includes the various controls necessary for operating the miner 10, as described hereinbelow.

Extending from the front of the miner 10 and ahead of the tracks 28 is a collection scoop 32 having its forward end lying adjacent the ground. As best illustrated in FIG. 3, the forward end of the scoop 32 is as wide as the miner 10 and tapers toward the rear. A pair of sidewalls 34 run along each side and define an opening 36 at the rear. As will be described more fully hereinafter, material which has been unearthed by the blade 18 is picked up by the scoop 32 and funneled rearward to a conveyor 40.

The conveyor 40 runs axially from the front to the rear of the tractor 12 to carry material which has been gathered by the scoop 32 to a rear discharge point 42. A roller-type crusher 44 is provided at the discharge point 42 to further reduce the size of the ore prior to off-loading. A tail conveyor 46 transfers the crushed ore to an ore transporter (not shown) which removes the ore from the mine.

The resonant beams 14 and 16 are typically elongate steel beams having a uniform rectangular cross-section, although other forms of resonant members, such as angulate beams, could be adapted to function in the present invention. The exact dimensions and composition of the beams are chosen so that the beams will display preselected resonant characteristics. Specifically, when resonantly excited at a particular frequency, the beams should display anti-nodes at each end and at least two nodal points therebetween. The anti-nodes are the points of maximum lateral displacement while the nodal points display little or no displacement when a lateral standing wave is induced in the beam. Thus, the cutting blade 18 may be reciprocated by synchronously exciting the beams in a manner which will be described in detail hereinafter.

Each beam 14 and 16 is suspended from its upper node in the associated support assembly 22 and 24, respectively. The support assemblies 22 and 24 are substantially identical and a detailed description will be provided only for the assembly 22. The description, however, will apply equally well to the other support assembly 24.

The support assembly 22 comprises an L-shaped support frame 50 including a first leg 52 and a second leg 54. The lower end of each leg 52 is pivotally attached to an axle 56 which is coaxial with the forward wheel of the track 28. The upper end of each leg 52 and 54 terminates in a shock-absorbing mount 58 which receives a shaft 60. The shaft 60 penetrates the beam 14 transversely along a line substantially coincident with its upper node, and is fixed thereto.

The shock-absorbing mount 58 isolates the surrounding support frame 50 from any vibrations present at the node. Typically, the shock-absorbing mount 58 includes a resilient member 62, such as a pneumatic tire, which is housed within an outer casing 64. The shaft 60 is received within a bearing which is encased within the resilient member 62. Thus, the resonant beam 14 is free to rotate about the axis formed by the shaft 60.

In addition to the beam 14, a channel frame 70 is also suspended from the shaft 60 and terminates at its lower end in a restraining frame 72. The length of the channel frame 70 is chosen so that the restraining frame 72 is located substantially at the lower node of the resonant beam 14. As best seen in FIG. 2, adequate clearance is provided within the channel frame 70 to allow the beam 14 to freely vibrate therein. Resilient pads 74 and 76 are provided within the restraining frame 72 to cushion the beam 14 at its lower node so that the beam may be manipulated by a support frame 50, as described in more detail hereinafter.

An upper hydraulic cylinder 80, having its rod end connected to the upper end of the support frame 50 (between legs 52 and 54) and its cylinder end secured to the tractor 12, is provided to adjust the pitch or angle of the blade 18 when the miner 10 is operating in its horizontal mode. By extending the rod forward, the support frame 50 will move forward to tilt the beam 14 within the frame channel 70. Retracting the rod tilts the beam 14 in the opposite direction.

An actuating assembly 90 is provided as part of the support frame 50 and acts to rotate the beam 14 about its upper node to achieve the annular cuts described hereinbefore. The assembly 90 includes a push bar 92 pivotally secured at its forward end to the restraining frame 72 and a guide track 94. The push bar includes a plurality of rollers 96 which allow the push bar to slide within the guide track 94. A second hydraulic cylinder 98 acts to extend the push bar 92 to raise the beam 14, as described in more detail hereinafter.

A pair of mounting legs 100 are secured to the lower end of each beam 14 and 16 by mounting plates 102. The mounting legs 100 are S-shaped and provide a rearwardly spaced mount for the cutting blade 18, as best observed in FIG. 2. The cutting blade 18 is secured to the lower face of a blade base 104 secured directly to the mounting legs 100 at an angle which is chosen for optimum performance, as described in more detail hereinafter. The inclination of the blade 18 provides a clearance 106 at the rear or the blade which prevents excessive friction as the blade travels over the ground.

An eccentric weight driver 110 is provided at the upper end of each resonant beam 14 and 16 (illustrated for beam 16 in FIG. 3) and comprises one or more eccentric weights 112 mounted on a shaft 114 which runs through a cleft 116 located substantially at the upper anti-node of the beam. The drivers 110 are driven by a common drive motor 118, typically a hydraulic motor, which is coupled directly to the drive shafts 114. The motor 118 is mounted on a cross frame 120 which is secured between the two channel frames 70 on either side of the miner 10. In addition to supporting the motor 118, the cross frame 120 assures that the resonant beams 114 and 116 move in unison when manipulated by the support assemblies 22 and 24.

Figure 4A:
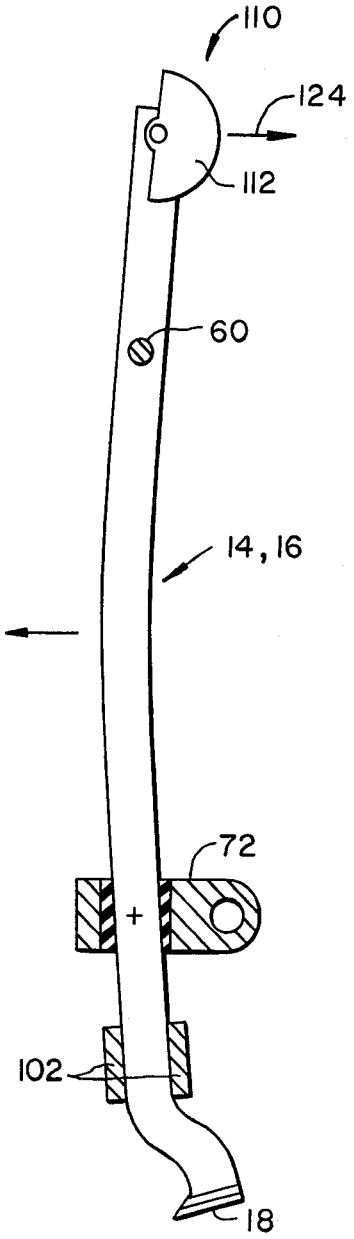
FIGS. 4A and 4B are partly schematic views illustrating the manner in which the resonant beam is driven by the oscillator.
Figure 4B:
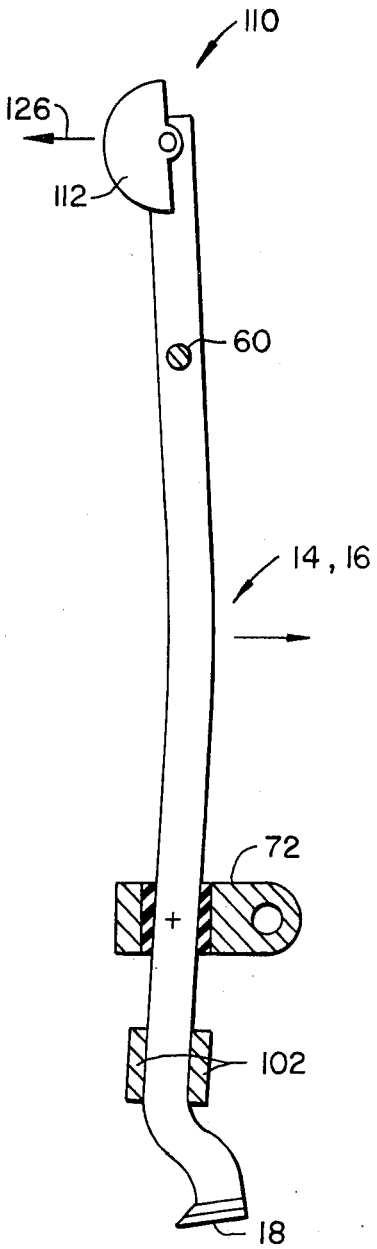

Referring now to FIGS. 4A and 4B, the eccentric weights 112 of the oscillator 110 act to induce a standing lateral wave pattern in each of the beams 14 and 16. As the eccentric weight 112 is rotated, in either direction, the upper anti-node of the beam experiences an outward centrifugal force varying over 360°. At any given moment, the axial component of the centrifugal force is substantially absorbed by the mass of the beam, while the lateral component of the force will act to deflect the beam.

As shown in FIG. 4A, the centrifugal force (indicated by arrow 124) is in the rightward lateral direction, deflecting the upper anti-node to the right. In FIG. 4B, the eccentric weight 112 has rotated 180° so that the centrifugal force (arrow 126) lies fully in the leftward direction. Thus, later force exerted by the eccentric weight 112 alternates from side to side, reaching a peak and then reversing direction.

Such an alternating force on the upper anti-node induces a standing lateral wave pattern in the beams 14 and 16 which results in reciprocation of the cutting blade 18. In FIG. 4A, both the eccentric weight 112 (upper anti-node) and the cutting blade 18 (lower anti-node) are deflected fully to the right and the blade 18 is poised to begin its cutting stroke. The blade then moves to the left and completes the cutting stroke as both the blade and the eccentric weight 110 reach the position shown in FIG. 4B. As the eccentric weight 112 continues its rotation, the cutting blade 18 returns to the position of FIG. 4A.

Figure 5:
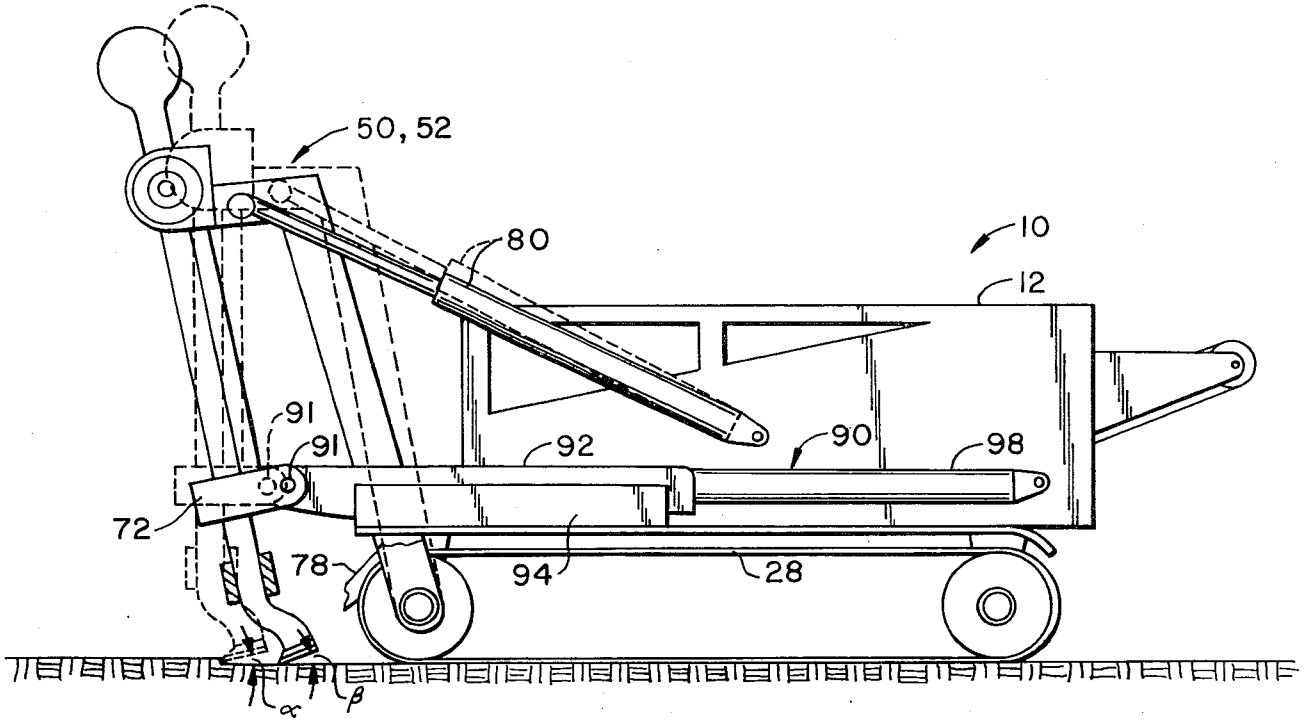
FIG. 5 is a partly schematic view illustrating the manner in which the blade angle is varied.

When operating in the horizontal mode, the resonant beams 14 and 16 of the miner 10 will be forwardly inclined from the vertical position, so that the blade 18 is pointed downward at an angle $\alpha$ (FIG. 5). The precise orientation of the blade 18 is adjusted as required for varying conditions. The lower node actuating assembly 90 is substantially retracted drawing the lower node into close proximity to the tractor 12, as shown in phantom in FIG. 5. The upper hydraulic cylinders 80 are then extended to tilt the upper end of the beams 14 and 16 forward about a pivot point defined by a pin 91 securing the restraining frame 72 to the push bar 92. By this motion, the cutting blade 18 is inclined at a steeper angle $\beta$ relative to the ground. Moreover it can be observed (in FIG. 5) that the push bar 92 is further retracted and the blade 18 is lowered by inclining the support frames 50 and 52 forward.

The blade 18 may be lowered without changing its pitch by extending both the first hydraulic cylinder 80 and the second hydraulic cylinder 98. In that case, the beams 14 and 16 will be lowered, but the lower nodes will be moved forward an equal distance so that the beams are not tilted. The actuating assembly 90, however, will have to lower an equal amount since it is attached to the restraining frame 72. Means for adjusting the elevation of the guide track 94 will typically be provided to allow height adjustment of the blade.

The control of the pitch angle of cutting blade 18 during horizontal operation is critical. In order to avoid unnecessary wear, high power consumption, high noise levels and the like, it is necessary that the return stroke of the blade 18 move through the void created by the blade on the cutting stroke. As will be explained, this requires that the blade 18 remain behind the horizontal location of the lower node of the beams at all times. This is accomplished by tilting the beams forward a preselected amount (depending on the length of travel of the cutting stroke) to move the node ahead of the blade 18.

Figure 6A:
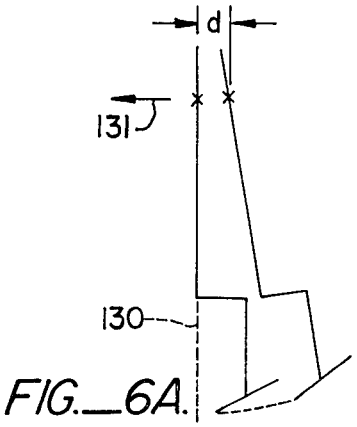
FIGS. 6A and 6B are schematic illustrations of the proper orientation of the cutting blade for making a horizontal cut.
Figure 6B:
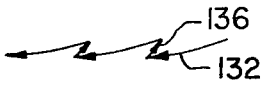

Referring now to FIGS. 6A and 6B, so long as the forward edge of the cutting blade 18 remains behind the horizontal position of the lower node (indicated by broken line 130) at all times during the cutting stroke, the blade will not travel through unbroken ground on the return stroke. During operation, the lower node will be travelling forward (in the direction of arrow 131), as the miner 10 is driven forward. Over the time required for one cutting stroke, the node will have moved at a distance d and the cutting edge will describe a line 132 (FIG. 6B). During the return stroke of the blade, the lower node will continue to move forward (over a second increment equal to d) while the forward edge of the cutting blade moves rearward, describing a second line 136. Thus, the alternate cutting and return strokes will create the pattern illustrated in FIG. 6B. It can be observed that at no time during the return stroke (arrows 136) will the cutting blade 18 move through ground which has not previously been broken during the cutting stroke, since the blade is moving upward and to the rear.

Figure 7A:
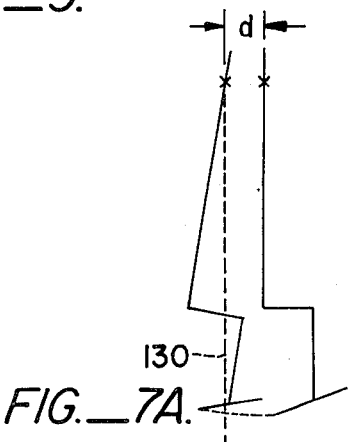
FIGS. 7A and 7B are similar to FIGS. 6A and 6B except that they illustrate the improper orientation.
Figure 7B:
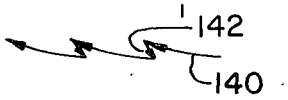

This situation is in contrast to operation where the cutting blade 18 moves forward of the lower node during its cutting stroke, as illustrated in FIGS. 7A and 7B. By passing forward of the node (indicated by broken line 130), the blade 18 begins to move upward and describes a cutting stroke indicated by arrow 140 in FIG. 7B. The return stroke then is in a downward direction (as illustrated by arrow 142) which causes the tip of the cutting blade 18 to travel through the ground which has not been previously broken. This is turn causes high friction, heating and excessive wear resulting from the undersurface of the blade 18 pushing downward against unbroken ground.

Thus, when operating in the horizontal mode, it is preferred that the cutting blade 18 be oriented so that it moves downward at all times during its cutting stroke and upward during the return stroke. This may be accomplished by tilting the beams 16 and 18 forward sufficient degree so that the blade remains behind the horizontal location of the lower node of the beam (defined by line drawn perpendicular to the surface being cut and through the lower node of the beam) at all times. This situation, however, is somewhat different when the blade is being operated in the vertical cutting mode, as will be described in detail hereinafter.

Figure 8:
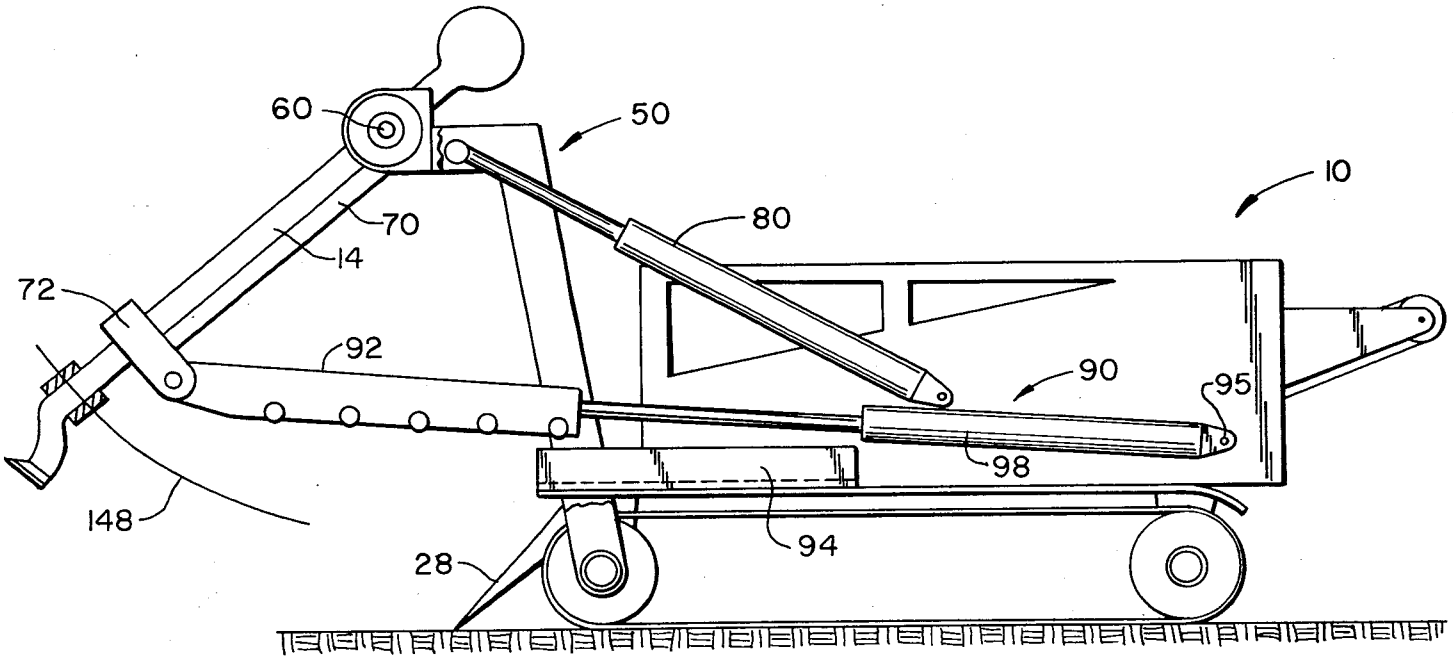
FIG. 8 is a partly schematic view illustrating the manner in which the cutting blade is advanced along an arc.

Referring now to FIG. 8, the actuating assembly 90 is extended forward to rotate the beams 14 and 16 about their upper nodes (shaft 60) to accomplish a vertical cut. The initial depth of the cut (and hence the annular width of the vertical cut), is determined by the initial elevation of the blade relative to the tractor 12 which is adjusted using both cylinders 80 and 98 as described hereinbefore. Once the elevation has been properly set, the cylinder 80 and the support assembly 50 remains stationary during the remainder of the cut.

As the cylinder 98 is extended, the push bar 92 urges the restraining frame 72 forward and upward about the shaft 60. The channel frame 70, which acts both to support the restraining frame 72 and to hold said frame is a substantially perpendicular orientation relative to the associated beam 14 or 16, will pivot relative to the push bar 92. The push bar 92 and lower cylinder 98 will be drawn upward and out of the guide track 94 with the restraining frame 72 and, as a consequence, will rotate about a rearward pivotal connection 95.

Since the beams 14 and 16 are supported at their upper nodes and restrained at their lower nodes, they may be driven by the oscillatory driver 20 at all times while it is being rotated upward, as just described. Thus, the cutting blade 18 is able to accomplish an arcuate cut while the tractor 12 remains stationary. By then returning the beams 14 and 16 to their vertical positions and moving the tractor 12 forward a small distance corresponding to the desired width of the annular cut, a second arcuate cut can be made in the same way.

As with the horizontal mode, it is desired during vertical mode operation that the blade 18 cut into the earth at all times durings its cutting stroke, while travelling only through the previously cut material on its return stroke. With vertical operation, however, this cannot be accomplished by controlling the pitch of the cutting blade 18, since the pitch necessarily varies as the beam 16 and 18 are pivoted upward. The same effect can be achieved, though, by off-setting the blade 18 substantially rearward of the center line of the beams 16 and 18, as will now be described.

During a vertical cutting stroke, the lower node will be moving forward and upward about the shaft 60, along an arc 148 (FIG. 8). To achieve the desired cutting characteristics, it is necessary that at each point during the cutting stroke, the blade 18 move away from the lower node and into the earth. This occurs only if the blade 18 remains behind the center lines of the beams 14 and 16 at all times, and is accomplished by off-setting the blade rearward by a distance greater than one-half the length of the cutting stroke.

In the preferred embodiment, the blade is off-set by the shape of the mounting leg 100 which maintains the tip of the blade behind the center line of the beams 14 and 16 at all times. The blade 18 is also mounted at an oblique angle relative to the beams 14 and 16 to provide heel clearance at its rear end and to accentuate the downward cut of the blade during the cutting stroke. The precise angle at which the blade is mounted will vary depending on the application.

While a preferred embodiment of the present invention is illustrated in detail, it is apparent that modifications and adaptions of that embodiment will occur to those skilled in the art. However, it is to be expressly understood that such modifications and adaptions are within the spirit and scope of the present invention, as set forth in the following claims.

What is claimed is:

1. A continuous miner capable of excavating ore from the ground both by making horizontal cuts and making vertical cuts, said continuous miner comprising:

a tractor;

a blade support frame pivotally secured to the forward end of the tractor;

a pair of substantially similar elongate resonant beams each having anti-nodes at each end and at least two nodes therebetween; said beams being pivotally suspended from the upper end of the support frame;

a cutting blade extending between the lower ends of the resonant beams and rigidly secured thereto, said cutting blade being off-set behind the center line of the beams by a distance greater than one-half the expected amplitude of reciprocation of the blade;

means for resonantly exciting the beams so that the blade is reciprocated to penetrate the ground;

means for pivoting the support frame to tilt the beams so that the blade assumes a proper inclination for making a horizontal cut as the tractor is driven forward; and means for translating the lower node about the pivotal attachment of the beam to the support frame so that the blade can make a vertical cut as the tractor remains stationary.

2. A continuous miner as in claim 1, wherein the resontant beams are secured substantially at their upper nodes to the blade support frame.

3. A continuous miner as in claim 1, wherein the means for resonantly exciting the beams includes at least one eccentric weight mounted at the upper anti-node of each beam and means for synchronously rotating the weights so that the beams vibrate in phase.

4. A continuous miner as in claim 1, wherein the means for pivoting the support frame includes a piston and cylinder assembly secured at one end to the upper end of the frame and at the other end to the tractor.

5. A continuous miner as in claim 1, wherein the means for translating the lower node includes a restraining frame for engaging each beam substantially at the lower node of the beam and a piston and cylinder assembly attached at one end to the restraining frame and at the other end to the tractor.

6. A continuous miner as in claim 5, wherein each restraining frame depends from the support frame so that the restraining frame moves along the same arc as the lower node when the lower nodes are translated.

7. A continuous miner as in claim 1, further comprising means for collecting the material unearthed by the miner and discharging said material from a single location.

8. A continuous miner as in claim 7, wherein said means for collecting comprises a scoop located behind the cutting blade and a conveyor for transporting material from the scoop to the discharge location.

9. A method for operating an excavating apparatus including a horizontal cutting blade rigidly secured to the lower anti-node of at least one substantially vertical resonant beam, said blade being off-set behind the center line of the beam by a distance greater than one-half the expected amplitude of reciprocation of the blade, said method comprising:

resonantly exciting the beam so that the blade reciprocates along a path about the lower anti-node; and driving the apparatus forward while maintaining the beam at an angle such that the blade lies behind the horizontal location of the lower anti-node at all points along the path.

10. A method as in claim 9, further comprising collecting the material unearthed by the excavating apparatus and discharging said material from a single location on the apparatus.

11. A method for operating an excavating apparatus, said apparatus including a horizontal cutting blade rigidly secured to the lower anti-node of at least one resonant beam capable of being inclined relative to the apparatus, said blade being off-set behind the center line of the beam by a distance greater than one-half the expected amplitude of reciprocation of the blade, said method comprising:

resonantly exciting the beam so that the blade reciprocates along a path about the lower anti-node; and inclining the beam so that the blade is translated through an upward arc in front of the apparatus to remove an arcuate layer of earth.

12. A method as in claim 9, further comprising collecting the material unearthed by the excavating apparatus and discharging said material from a single location on the apparatus.

* * * * *